428-408
7/21/87 XR 4,681,049

United States Patent [19]
Vees et al.

[11] Patent Number: 4,681,049
[45] Date of Patent: Jul. 21, 1987

[54] CURVED, UNIFORMLY BIASED STRUCTURAL FIBER FORMS

[75] Inventors: Frederick Vees, Eden Prairie; Todd Drummond, Hopkins, both of Minn.

[73] Assignee: Xerkon Company, Minneapolis, Minn.

[21] Appl. No.: 803,226

[22] Filed: Dec. 2, 1985

[51] Int. Cl.[4] ..... D05B 1/00
[52] U.S. Cl. ..... 112/262.3; 428/102; 428/105; 428/408; 428/902
[58] Field of Search ..... 428/101, 109, 110, 111, 428/113, 408, 902, 36, 192, 105; 156/172, 173, 174; 112/262.1, 262.3

[56] References Cited

U.S. PATENT DOCUMENTS 4,325,999 4/1982 Campman et al. ..... 428/112
4,401,495 8/1983 McKinney ..... 428/113
4,416,929 11/1983 Krueger ..... 428/285
4,550,045 10/1985 Hutson ..... 428/102

*Primary Examiner*—James J. Bell
*Attorney, Agent, or Firm*—Oblon, Fisher, Spivak, McClelland & Maier

[57] ABSTRACT

A process for forming a dry fiber form susceptible of being infused with a resin and molded to a fiber reinforced plastic structural article, wherein the fiber form in comprised of a structural fabric bearing plys of biased yarns, the bias of the yarns being maintained along the curvature of the fiber form, without wrinkling or buckling of the fiber form. The structural fabric is attached to a form bearing a shape-defining opening, and threads are sewn within the opening. The fabric is then removed from the form, and the ends of the fabrics are then sewn with more threads parallel to the first set of threads. Thereafter, the excess is trimmed away, and the resulting sewn fiber form may be infused with resin and molded into a structural article.

5 Claims, 5 Drawing Figures

CURVED, UNIFORMLY BIASED STRUCTURAL FIBER FORMS

BACKGROUND OF THE INVENTION

1. Field of the Invention:

This invention pertains to the art of structural composite materials, or elements of those materials, in particular, fiber forms prepared from non-woven structural fabric. In particular, this pertains to fiber forms wherein at least some of the yarns present are biased at an angle other than 90° with respect to the axis of the fabric, the fiber forms being curved, and the bias of the yarns being maintained over that curve.

2. Background of the Prior Art:

Increasing demands in the transportation industry, including the rail, marine and aerospace fields, coupled with the increasing cost of energy, has placed a high demand on structural materials that are of extreme strength, durability, and at the same time, light weight. Thus, replacements for conventional alloys, and even lighter weight alloys such as aluminum, are constantly being sought. One such group of substitutes includes the composites field, generally including fiber reinforced plastic. One important type of product within this field is the structural article made by infusing or impregnating a non-woven, stitched structural fabric comprised of a plurality of plys of structure yarns (modulus generally in excess of about 6 million, including fiber glass, Kevlar TM, boron and graphite) with a curable resin, and thereafter molding the product to provide a stiff, light weight finished product. Such non-woven stitched fabrics, and products that may be produced therefrom, are disclosed in U.S. Pat. Nos. 4,416,929, 4,484,459 and 4,550,045, among others. The shaped article to be resin infused is generally known as a fiber form.

Given the disclosure of these references, it is well within the skill of those in the art to prepare articles of simple shape, having straight edges, and no complex configuration or curve. However, where a curved shape is sought, conventional prior art processes used wet, preimpregnated, "tapes", or unitapes, because of the well developed technology concerning the application and lay down of such tapes. Again, in most circumstances, the production of a shape of complex curvature is easily accomplished using such tapes.

However, in certain critical applications, including aerospace applications, it is necessary to include many layers of structural yarn wherein the yarn is biased with respect to the axis of the fabric, generally at angles greater than 30° and in particular ±45°. When preimpregnated tapes, or infused fabrics, are employed to prepare curved articles using such biased fabrics, at least two critical problems are encountered. First, owing to the curve in the alignment of the fabric, the bias of the structural yarns is frequently distorted, or destroyed entirely. Although the yarns may end at a given angle, it is not constant along the radius of curvature. Particular applications, such as the preparation of "stringers" and stiffening members for airplanes and the like, require that the bias be constant, uniform and reproducible. The second problem encountered, particularly when using tapes or other wet products, is the tendency of these tapes to buckle or wrinkle when distorted around a curve. Such distortion and wrinkles frequently give rise to voids and flaws in the formed article, rendering them structurely unsound, and unfit for many applications.

Accordingly, there continues to be a pressing need for a curved fiber form with biased yarns, wherein the bias is maintained around the curve at a constant angle, suitable for impregnation with resin and subsequent molding. Similarly, there currently exists no known process for preparing the same.

SUMMARY OF THE INVENTION

It is an object of this invention to provide a process for preparing a curved fiber form with biased yarns, wherein the bias of the yarns is maintained over the curvature at a constant value, and which is suitable for impregnation with a resin and a subsequent curing, without wrinkling or buckling of the fabric of the fiber form.

It is another object of this invention to provide a fiber form meeting the above-described requirements.

These and other objects of the invention are achieved by making a form which defines an opening contained within that form which corresponds to the desired shape of the fiber form, in terms of width, length and curvature. A non-woven, stitched structural fabric having the number of plys desired in the final product and having the appropriate orientation within those plys to meet the biasing requirements of the final project is attached to the form, completely occluding the shape-defining opening therein.

Thereafter, holding threads are sewn in parallel lines within that opening, conforming to the shape of that opening. The sewn threads extend the length of the opening, and are repeated from one edge of the opening to the other.

The sewn fiber form will now conform to the shape of the opening. However, in order to provide an article ready to be impregnated, the ends of the fiber forms, which were previously overlapping on the form, must also be sewn. To accomplish this, a vertically disposed cradle, capable of translational motion along an arc, is provided, and the fiber form clamped thereto, in a fashion such that the edges of the sewn fiber form remain free. A sewing machine is brought into position over the fiber form, and the fiber form is sewn again, in parallel with the previous sewing lines, by moving the cradle along its arc. At the end of each line, the sewing machine is displaced slightly, and another line sewn, until the entire width of the fiber form that will correspond to the finished article has been sewn. The excess is thereafter trimmed.

The resulting product has the curvature of the shape-defining opening, and each bias yarn in the individual plys of the finished fiber form maintains that bias across the curve. When the dry fiber form is bent to be attached to the form, the fibers actually slide in response to the tension created, and accordingly, the bias is maintained by actually curving the yarn. Of course, because the entire fabric is now curved, this results in a maintenance of desired biased angle. The finished product may thereafter be infused or impregnated with a resin, and cured, to give the desired structural article.

DETAILED DESCRIPTION OF THE INVENTION

Figure 1:
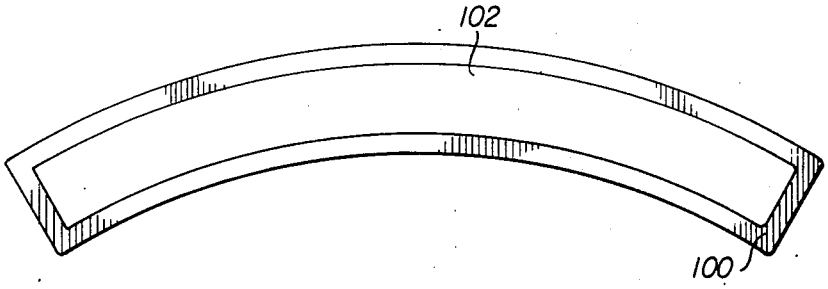
FIG. 1 is an illustration of a suitable form, provided with a shape-defining opening.
Figure 2:
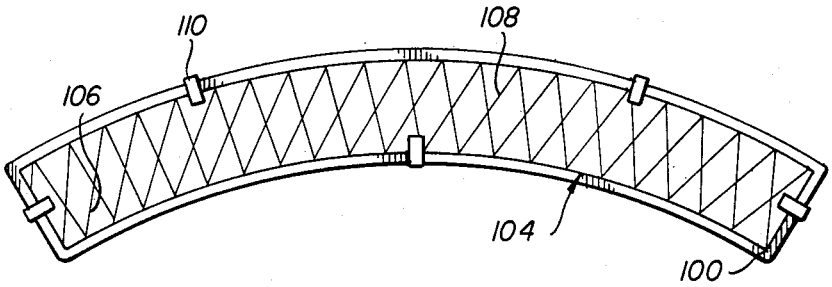
FIG. 2 is an illustration of a structural fabric attached to the form, completely including the shape-defining opening.

The above objects, and others, can be further understood by reference to the detailed description provided below, which refers to FIGS. 1-5, wherein like reference characters indicate like parts in all drawings.

In order to prepare the fiber form of this invention, a form, or stencil, must be provided. A suitable form is illustrated in FIG. 1. The form is comprised of a frame 100, which defines an opening 102 therewithin. Opening 1 or 2 should be formed so as to correspond to the length, width, and curvature of the desired end fiber form.

A structural fabric 104, containing the desired number of plys of the finished article, wherein at least some of the plys of that fabric contained biased structural yarns 106 and 108 is attached to the form, completely occluding opening 102. This attachment may be achieved by use of clamps 110, or other conventional means, including tape, glue and the like.

It is critical to the claimed invention that the fabric employed be non-woven, and be "dry", that is, not impregnated with any resin at all. When such fabrics are used, the structural yarns can "slip" or "slide" to a certain degree within the fabric, when bent about the shape-defining opening 102. This bending will be uniform along the curvature, such that, when the final shape has been achieved, the bias of the yarns will remain, although the yarns themselves will curve, in a degree corresponding to the curvature of the shape, from one long edge to the other of the fiber form. Thus, one point of criticality of the claimed invention is the use of a dry, or non-impregnated structural fabric. In this respect, the claimed invention is distinct from prior art processes involving tapes and the like, which are considered "wet" products.

Figure 3:
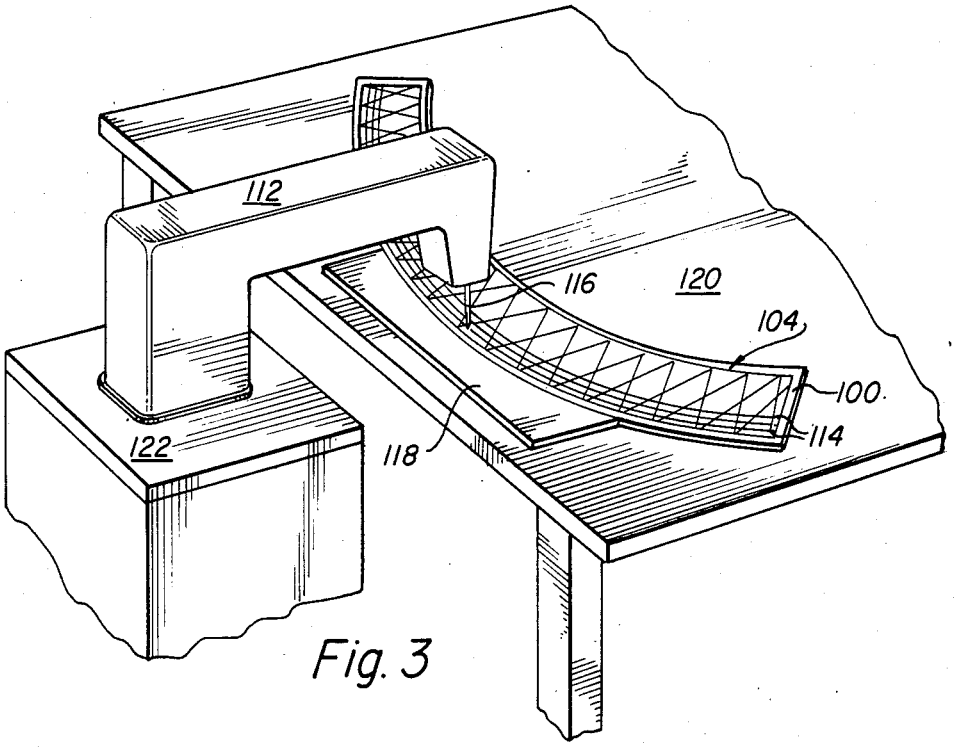
FIG. 3 is a perspective view of the first sewing operation within the form opening, illustrating a point nearly at the end of that sewing process.
Figure 4:
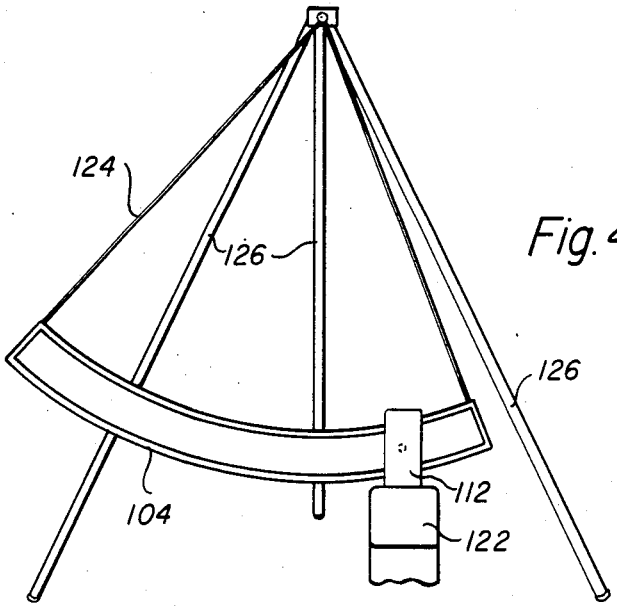
FIG. 4 is an illustration of the vertically disclosed cradle used to achieve the second sewing stage of the process of this invention, together with the sewing machine associated therewith.

As illustrated in FIG. 3, the form 100, bearing the curved fabric 104, is placed on a support member, such as table 120, which can be brought into proximity to a sewing unit 112, which may be preferably based on an independent table 122, which may be rolled away from and towards table 120. Beginning at one side of the fiber form, and continuing in parallel lines to the other, a holding thread is sewn into the curved fabric. These parallel threads are designated 114. The sewing machine used can be of any conventional, industrial type, provided that the actual head and needle 116 are of sufficient strength and sized to penetrate the fiber form which can be 100 plys or more thick.

Similarly, sewing threads 114 can be of any desired composition, saved that they must be strong enough to meet the requirements of the end product. Essentially, sewn threads 114 maintain the fiber form in its curved configuration. In prefered embodiments, these threads include polyester threads and polyamide threads such as Kevlar TM, although virtually any synthetic or natural thread can be used, depending on the application.

In order to facilitate the sewing of the fabric, a guide 118 may be employed. The guide should correspond to the shape of the opening 102, so as to insure that the sewn threads 114 are as parallel as possible. Of course, guide 118 may be dispensed with if the form is provided with some type of track to run in, or the form is manually moved while sewing continues.

At the end of this first sewing step, the fiber form has been nearly entirely sewn, and certainly, the fabric has been converted into the desired shape. The fabric is removed from form 100, whereupon the curve imparted by the sewing remains. However, the ends of the fiber form, which were attached to form 100, are still loose. In order to provide a product having the necessary uniform strength and characteristics, these ends must be sewn, again, in the desired curvature. In a preferred embodiment, to achieve this end, the partially sewn fabric 104 is transfered and adhered to a cradle 124, which is capable of translational movement along an arc. The cradle is supported in a conventional fashion, for example, by tripod 126, to allow free movement of the cradle. A sewing unit, which may be unit 112 on movable table 122, or any other suitable machine, is brought into proximity with the fabric 104, in position that the fabric may be sewn through from above. As sewing proceeds, the cradle is moved along its arc. At the end of each arc, the sewing machine is displaced slightly, and the cradle returns, this step being repeated until the ends of the fiber form have been sewn. At the end of this step, any excess yarn, or fabric, is trimmed away. Of course, any method of bringing the sewing unit and the fiber form into close relationship and sewing along the fiber form curve may be used. Thus, the fiber form may be held constant, and a suitable, mounted sewing machine may be displaced horizontally and vertically along a predetermined path.

Figure 5:
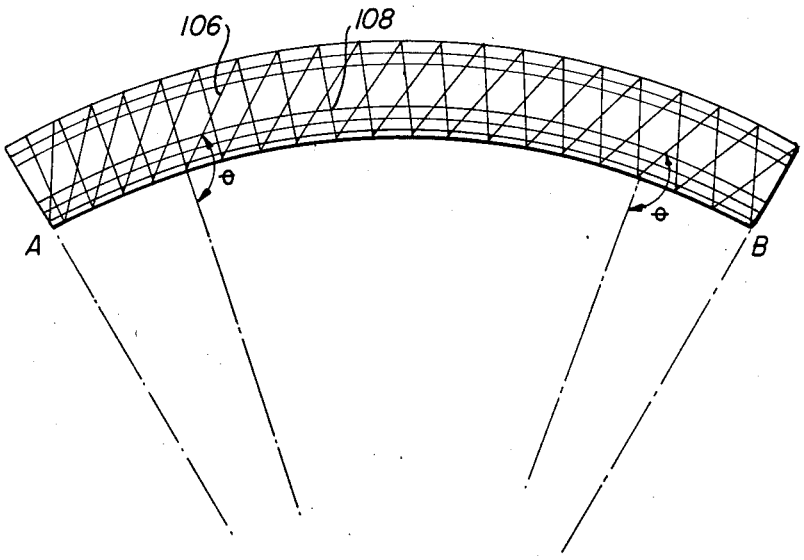
FIG. 5 is a representational illustration of the finished fiber form.

The resulting article is illustrated in FIG. 5. The original dry fabric has now been bent into a curved shape, wherein the bias of each bias layer in the original fabric is maintained along the curvature of the article, from points A to B. The angle theta defined by the intersection of the radius of the curve with the biased yarns is equal all along the curvature of the fabric. This is true whether this intersection is measured at the interior of the fabric, in the middle of the fabric, or at the exterior edge of the fabric. This is because the bias yarns, in being bent around the curvature, actually slide or slip into a curved configuration, so that the bias is maintained.

The finished article may now be infused or impregnated with a curable resin, and subsequently molded to form a composite, structural article of exceedingly high strength, meeting any specific requirements, and being reproducible.

Of course, the possible shapes that the fiber form may assume are limitless. A simple curvature has been illustrated. Other curves or shapes that may be contemplated include nacelles and "J" figures, which are frequently used as reinforcing parts. The article may include a plurality of curved and straight portions, such in a nacelle, or be a single, long curve, as illustrated. The invention is not limited or defined by the nature of the curvature, save that some curve must be present.

It should also be noted that the final product produced from this fiber form need not be two dimensional. If it is desired to bend the fiber form to provide flanges, such as in a Z-cross section article, or any other desired bending, this can be easily achieved through conventional processes, such as match molding, because the fiber form remains drapeable and flexible along its width. The only direction in which the fiber form will not flex is in the direction of its curvature.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for making a dry fiber form of desired curved shape comprising the steps of:

attaching a dry structural fabric comprised of a plurality of plys of structural yarns, wherein the yarns of at least one ply are biased with respect to the axis of said fabric, to a form bearing an opening defining said desired shape in such fashion to completely occlude said opening by bending said fabric about said opening;

sewing a plurality of first courses of holding thread within that opening parallel to the curvature of said opening from end to end of said opening;

removing said sewn fabric from said form and sewing a plurality of second courses of holding threads along the edges of said fabric parallel to said first threads;

trimming the excess of said fabric to said desired shape.

2. The process of claim 1, wherein said sewing of the edges of said fabric is achieved by attaching the fabric to a vertically disposed cradle capable of translational movement along an arc, and sewing along said fabric while said cradle is displaced relative to a sewing unit.

3. The process of claim 2, wherein said structural yarns are selected from the group consisting of fiberglass, polyamid, boron, and graphite.

4. The process of claim 1, wherein said threads are comprised of polyester or polyamide fibers.

5. A product produced by the process of claim 1.

* * * * *